US009827454B2

(12) United States Patent
Stambaugh et al.

(10) Patent No.: US 9,827,454 B2
(45) Date of Patent: Nov. 28, 2017

(54) OIL FIRE AND BOIL OVER ATTENUATION USING BUOYANT GLASS MATERIALS

(75) Inventors: Brandon Alan Stambaugh, Export, PA (US); Steven Robert Badger, Pittsburgh, PA (US)

(73) Assignee: Pittsburgh Corning Corporation, Pittsburgh, PA (US)

( * ) Notice: Subject to any disclaimer, the term of this patent is extended or adjusted under 35 U.S.C. 154(b) by 786 days.

(21) Appl. No.: 13/040,673

(22) Filed: Mar. 4, 2011

(65) Prior Publication Data

US 2012/0018178 A1 Jan. 26, 2012

Related U.S. Application Data

(60) Provisional application No. 61/310,915, filed on Mar. 5, 2010.

(51) Int. Cl.
*A62C 2/00* (2006.01)
*A62C 3/06* (2006.01)

(52) U.S. Cl.
CPC ..... *A62C 3/065* (2013.01)

(58) Field of Classification Search
CPC .. A62C 3/065; A62C 2/00; A62C 3/06; A62C 99/0018; A62C 99/0072; A62C 3/02; A62C 35/68; A62C 27/00; A62C 31/005; A62C 5/02; A62C 31/12; E21B 35/00; A62D 1/0071
USPC ..... 169/46, 43, 44, 45, 47, 48; 252/3, 8; 52/746.1, 746.11
See application file for complete search history.

(56) References Cited

U.S. PATENT DOCUMENTS

| | | | | | |
|---|---|---|---|---|---|
| 2,437,125 | A | * | 3/1948 | Plummer | 220/221 |
| 2,873,042 | A | * | 2/1959 | Fino | 220/222 |
| 2,936,834 | A | * | 5/1960 | Gomory | 169/44 |
| 3,300,289 | A | * | 1/1967 | Long | 65/22 |
| 3,696,051 | A | * | 10/1972 | McGuire | 502/401 |
| 4,751,203 | A | * | 6/1988 | Toussaint et al. | 501/33 |
| 5,035,804 | A | * | 7/1991 | Stowe | 210/671 |
| 2007/0068685 | A1 | | 3/2007 | Arnott | |

OTHER PUBLICATIONS www.foamglas.com, Foamglas Insulation Systems, Rev. 2/09, Pittsburgh Corning USA, FI-201 5M Rev. 2/09 Replaces Rev. 12/04, p. 1-34. http://www.insulation.org/mtl/pdfs/000256_494.pdf.*
International Preliminary Report on Patentability for corresponding to International Application No. PCT/US2011/027169, Sep. 20, 2012.
International Search Report for corresponding to International Application No. PCT/US2011/027169, Apr. 19, 2011.
Written Opinion for corresponding International Application No. PCT/US2011/027169, Apr. 19, 2011.

* cited by examiner

*Primary Examiner* — Chee-Chong Lee
(74) *Attorney, Agent, or Firm* — Reed Smith LLP

(57) ABSTRACT

A method is described for using cellular glass blocks, cellular glass nodules, hollow glass spheres, or other buoyant glass materials to attenuate oil fire, limit thermal radiation from an oil fire, and reduce the risk of boil-over phenomenon. Cellular glass blocks, cellular glass nodules, hollow glass spheres, or other buoyant glass products may be deployed passively, prior to an ignition event, or actively, as a response to an ignition event to provide control. Cellular glass or other buoyant glass materials may be in any physical shape such as block, sheet, aggregate, or nodule.

1 Claim, 6 Drawing Sheets

OIL FIRE AND BOIL OVER ATTENUATION USING BUOYANT GLASS MATERIALS

PRIOR APPLICATION

This application claims priority from U.S. Application No. 61/310,915, filed Mar. 5, 2010, entitled "Oil Fire and Boil Over Attenuation Using Buoyant Glass Materials".

BACKGROUND OF THE INVENTION

Field of the Invention

This invention relates to a method for using cellular glass blocks, cellular glass nodules, hollow glass spheres, or other buoyant glass materials to attenuate oil fire, limit thermal radiation from an oil fire, and reduce the risk of boil-over phenomenon. Cellular glass blocks, cellular glass nodules, hollow glass spheres, or other buoyant glass products may be deployed passively, prior to an ignition event, or actively, as a response to an ignition event to provide control. Cellular glass or other buoyant glass materials may be in any physical shape such as block, sheet, aggregate, or nodule. While the descriptions herein focus on oil fires, one of ordinary skill in the art would understand that these methods could be applied not only to oil but also to all other similar hydrocarbon liquids. For convenience, the term "oil" will refer to all such hydrocarbons.

Background of the Invention

Oil fires are dangerous and often disastrous industrial events. Depending on the type of oil fuel, these fires can reach extremely high temperatures and result in the phenomenon known as "boil over". Boil over may occur during an oil fire when a liquid phase in the oil vaporizes, causing the oil to boil, and results in spillage and catastrophic spreading of burning oil near the storage vessel.

A boil over can occur in crude oil tank fires when a "hot zone" of dense, hot fuel descends through the crude and reaches any water base. The water turns to steam, expanding in the order of 1500:1. This steam pushes up through the crude, taking fuel with it and creating a "fireball" above the tank. Boil overs have spread burning crude several tank diameters from the source, thus escalating the incident and endangering fire responders.

Buoyant glass products can be applied to the surface of oil, either passively before the ignition event, or as a response to the ignition event, to attenuate oil fires, limit thermal radiation from oil fires, and reduce the risk of boil over phenomenon from vaporization of the liquid phase. This attenuation can increase the amount of time one has to deploy firefighting measures, potentially saving lives and damage to adjacent equipment.

One buoyant glass product that could be utilized to reduce the risks of oil boil over includes cellular glass. The use of cellular glass as a thermal insulating material is well known. Cellular glass is an inorganic closed-cell material with high resistance to fire, moisture, vermin and mold growth. Cellular glass has been made in the past by processes disclosed in a number of patents, such as U.S. Pat. Nos. 2,255,238, 2,322,581, and 2,156,457. This prior art illustrates the making of cellular glass blocks for thermal insulation. As one of ordinary skill in the art is aware, the process includes mixing powdered glass material with a cellulating agent and partially filling a mold with the powdery mixture. The mold is heated until the powdery mixture softens, coalesces and the cellulating agent reacts to cellulate in the mixture to produce a bun of cellular glass. The bun is then annealed and cut or trimmed into a desired shape.

Cellular glass has many desirable properties, including dimensional stability, low density, low thermal conductivity, and high compressive strength. Since cellular glass is inorganic and made primarily from glass, it has a natural ability to attenuate thermal radiation and resist fire for extended periods of time. Cellular glass is specified on many industrial applications, such as pipe and vessel insulation, as well as in many building insulation applications. The cellular glass insulation properties are due in part to the ability of cellular glass to resist fire and protect equipment from thermal damage. Since cellular glass is closed-cell and lightweight, it is buoyant on most liquids including water, liquid natural gas (LNG) and oils. During World War II, for example, cellular glass was used to float nets in harbors to prevent enemy submarines from entering freely. More recently, the buoyancy and fire resistant properties of cellular glass have made it an ideal component for LNG pool fire suppression systems.

Glass spheres and other buoyant glasses will have similar performance characteristics as cellular glass when considering this invention.

Cellular glass has been utilized in various applications, such as pipe and vessel insulation, to limit damage to mechanical systems as a result of fires. These are largely protective measures against external thermal events that have the potential to damage unprotected equipment, and are not used to attenuate oil fires, limit thermal radiation from oil fires, and reduce the risk of boil over phenomenon.

Accordingly, it is an object of the present invention to provide an improved product and method, using cellular glass or other similar buoyant glass materials, to attenuate oil fires, limit thermal radiation from oil fires, and reduce the risk of boil over phenomenon.

SUMMARY OF THE INVENTION

In accordance with the present invention, there is provided a method of controlling an oil fire, limiting thermal radiation from an oil fire, and attenuating the boil over phenomenon using cellular glass, glass spheres or other buoyant glass.

Cellular glass blocks, cellular glass nodules, hollow glass spheres, or other buoyant glass products may be deployed passively, prior to an ignition event, or actively, as a response to an ignition event to provide control. Cellular glass or other buoyant glass materials may be in any physical shape such as block, sheet, aggregate, or nodule. An embodiment of this invention includes the direct placement of buoyant glass materials on the roof of an external floating roof oil tank or other storage vessel.

A buoyant glass product dispersed on the surface of an oil fire lower the risks associated with and oil fire. In particular, cellular glass has the following advantageous properties:

- It is "solid foam" that acts as a floating barrier to insulate a burning liquid surface.
- It is a non-flammable material.
- Cellular glass floats on most flammable liquid pool surfaces. It remains independent of the amount of pool depth, and creates constant coverage when applied correctly.
- It has a completely closed cell structure; as a result, no liquids are absorbed during contact.
- The structure is stable at flame temperature, and no reapplication or further coverage maintenance is generally required.

It is waterproof, impervious to water vapour, acid resistant and is easily cut to shape. It has high compressive strength, and is also dimensionally stable.

Cellular glass can be easily arranged to take the shape of desired coverage area.

Testing has demonstrated that the cellular glass material reduces significantly the radiation flux received by external targets and observers when compared to a crude oil fire without the material being applied. This was shown from radiometers deployed around a test pan filled with crude oil. However, potentially the most valuable finding of testing was that the probability of boilover was reduced when the cellular glass blocks were left in situ on top of the crude oil surface in the test "tank", in which case boilover did not occur. During the test with the cellular glass blocks, both visual and radiometer observations confirmed that the severity of burning was reduced greatly with flame height and volume significantly less than for a free-burning crude fire; consequently, thermal feedback to the fire was lessened and the formation of a "hot zone" necessary for boilover conditions was delayed or even stopped altogether. While heat transferred through the uppermost layers of the oil, penetration was minimal when compared to the equivalent test without the cellular glass material.

In another test, extinguishment of a fire using "semi aspirated" foam at a critical application rate—approximately half of that specified for monitor (foam cannon) application in NFPA 11—Standard for Foam—occurred relatively quickly for a fire that had been burning for an extended period. The foam was observed to coat the cellular glass blocks before sinking between the gaps in the blocks and eventually (after a period of only four minutes) the fire was completely extinguished. This clearly showed the ability of the foam solution (a relatively fluid type) to flow around the blocks and therefore demonstrated the feasibility of using fire fighting foam in combination with the cellular glass system when applied to atmospheric storage tanks. High expansion foam is routinely used in combination with the cellular glass for LNG fire control.

When cellular glass was applied to a fire after a pre-burn period, the cellular glass reduced flame height and volume once the material was distributed onto the burning liquid. Although a "hot zone" had begun to form in the crude (when sustained, a hot zone eventually results in boilover) subsequent development appeared to be delayed. Based on the tests, it is reasonable to assume that a boilover would probably be delayed, if not avoided altogether, providing the hot zone did not develop further or sink to the water layer.

BRIEF DESCRIPTION OF DRAWINGS

For the present invention to be clearly understood and readily practiced, the present invention will be described in conjunction with the following figures, wherein like reference characters designate the same or similar elements, which figures are incorporated into and constitute a part of the specification, wherein.

DETAILED DESCRIPTION OF PREFERRED EMBODIMENTS OF THE INVENTION

It is to be understood that the figures and descriptions of the present invention have been simplified to illustrate elements that are relevant for a clear understanding of the invention. The detailed description will be provided hereinbelow with reference to the attached drawings.

Cellular glass is a material composed primarily of glass that contains a significant number of completed closed bubbles in the material to form a lower density material than a solid glass product. Cellular glass may generally range in density from three pounds per cubic foot up to the density of the oil product in which it will ultimately need to float (which will vary). The greater the difference between the density of cellular glass and that of the oil, the more buoyant the cellular glass system will be, and the greater the protection the system will provide.

Cellular glass will be closed celled, so that oil absorption will not result in premature system failure due to the cellular glass sinking in oil. Other glass products such as hollow glass spheres may also be utilized due to the buoyant nature of the material.

Figure 1:
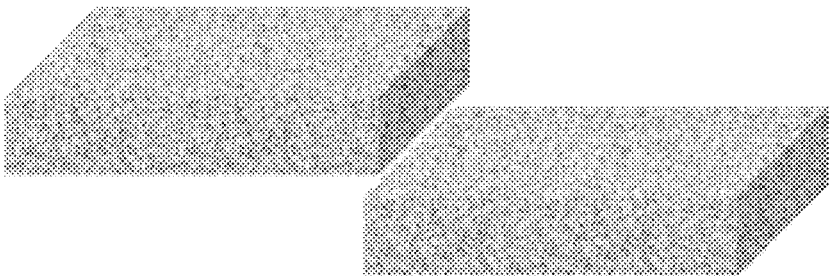
FIG. 1 (Prior Art)
FIG. 1 illustrates an example of cellular glass in block form.
Figure 2:
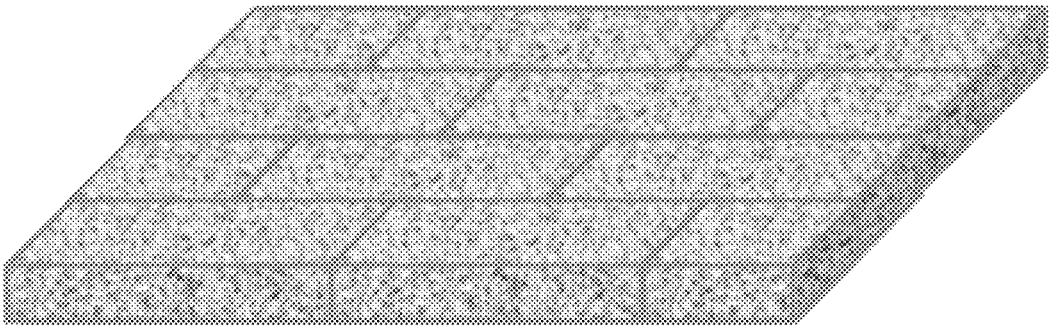
FIG. 2 (Prior Art)
FIG. 2 illustrates an example of cellular glass in sheet form.
Figure 3:
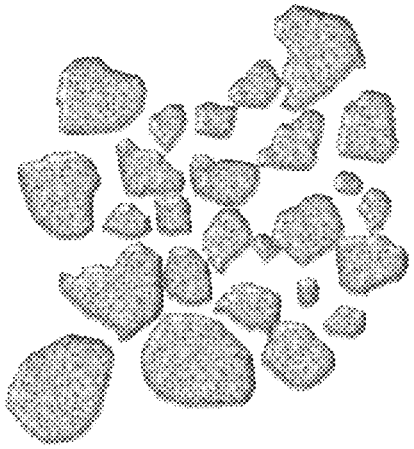
FIG. 3 (Prior Art)
FIG. 3 illustrates an example of cellular glass in aggregate form.
Figure 4:
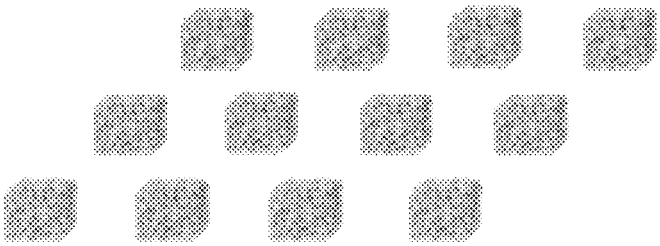
FIG. 4 (Prior Art)
FIG. 4 illustrates an example of cellular glass in nodule form.
Figure 5:
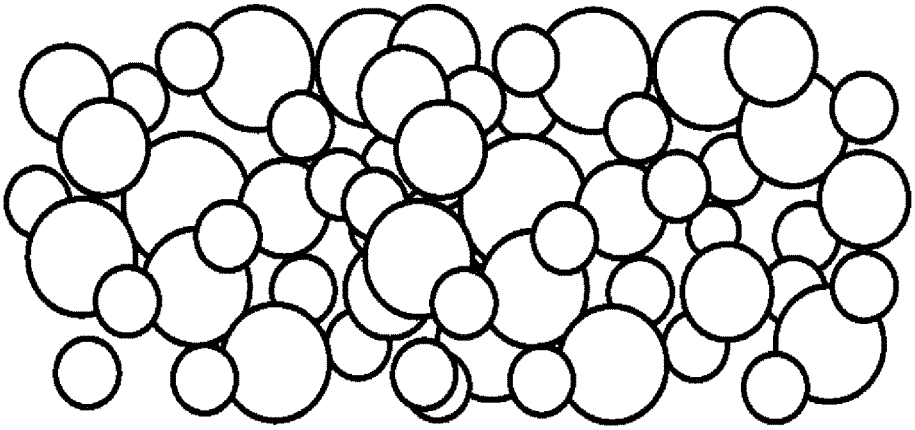
FIG. 5 (Prior Art)
FIG. 5 illustrates an example of cellular glass in hollow sphere form.

Cellular glass may be in block (FIG. 1), sheet (FIG. 2), aggregate (FIG. 3) or nodule (FIG. 4) form. Individual blocks preferably are no more than a few feet in length or width and no more than twelve inches thick. Multiple blocks may be constructed into large sheets using adhesive or mechanical fasteners, or specifically fabricated to cap the roof area of the storage vessels. Aggregate cellular glass is typically smaller than a few inches in diameter and may or may not have uniform geometry. A nodule is characterized as a small uniform diameter spherical or cubic cellular glass shape and typically is less than a few inches in diameter. Unlike multicellular glasses, hollow glass spheres (FIG. 5) are a singular glass cells, and are typically smaller than a quarter of an inch in diameter.

Cellular glass may have a surface coating used to improve weatherability and fire control. These coatings can include, but are not limited to, UV resistant and intumescent materials.

Other buoyant glass materials may also be utilized in the application for limiting risks associated with oil fires. In one embodiment of this invention, the glass material can be hermetically sealed buoyant glass spheres. The hollow glass spheres will typically be less than half an inch in diameter. These products may be either used in a passive deployment basis or placed onto a fire surface during response. One example of this invention would include adding hollow glass spheres to a firefighting foam.

Figure 6:
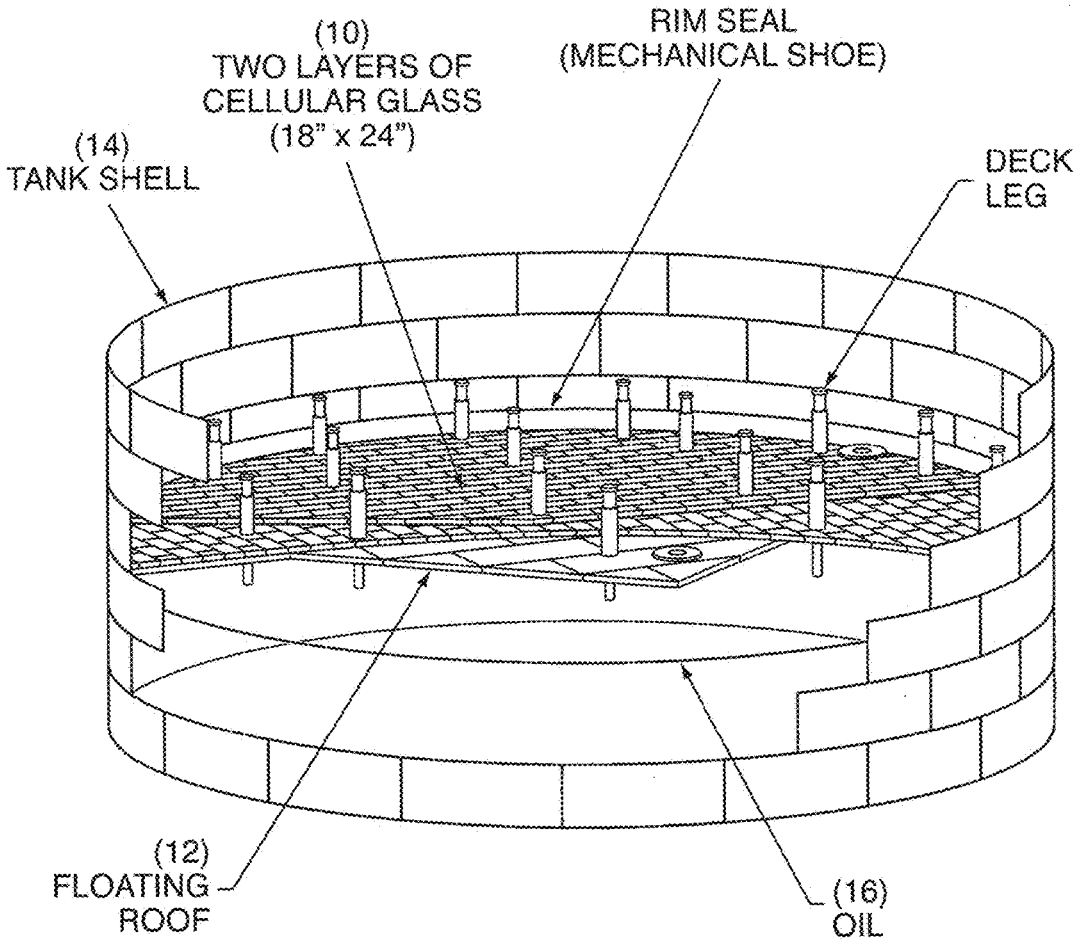
FIG. 6 illustrates an example of an external floating roof oil tank with a passive system of cellular glass block deployed in two layers.
Figure 7:
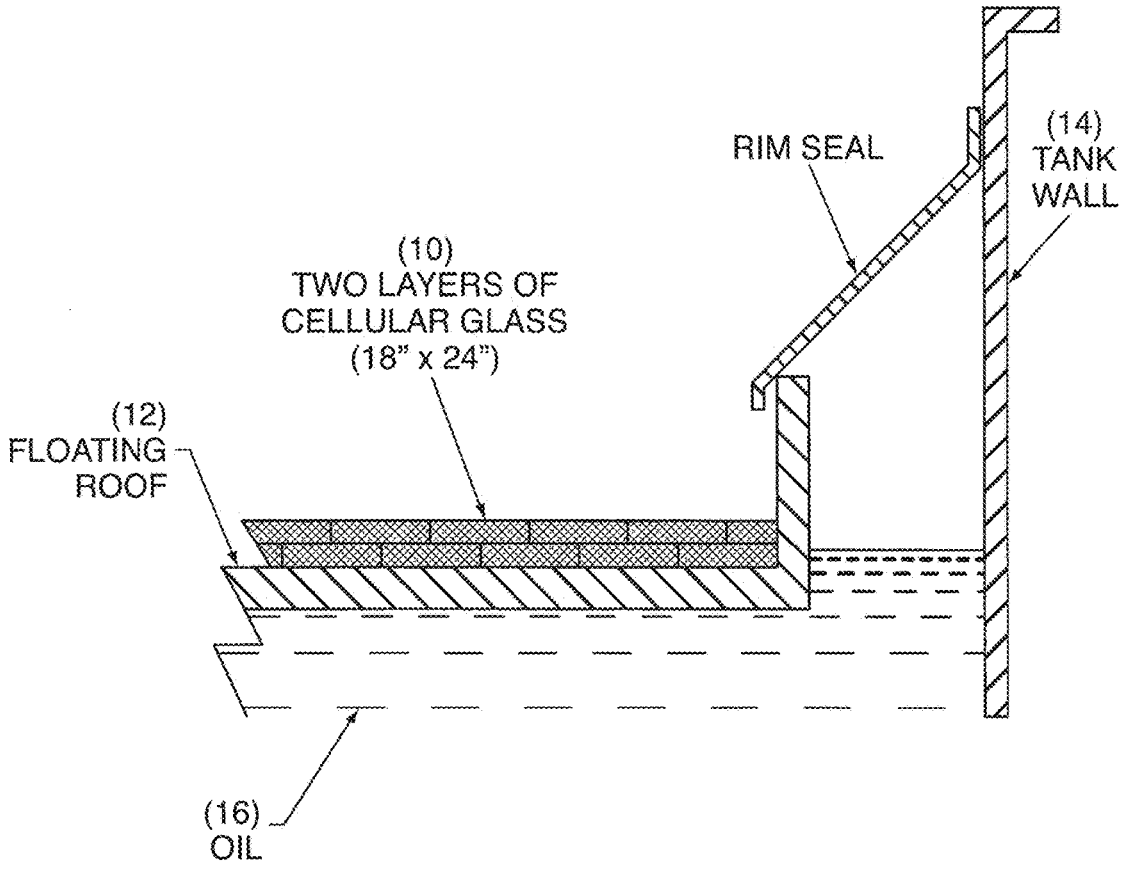
FIG. 7 illustrates a cross-section detail of an external floating roof oil tank with a passive system of cellular glass block deployed in two layers.
Figure 8:
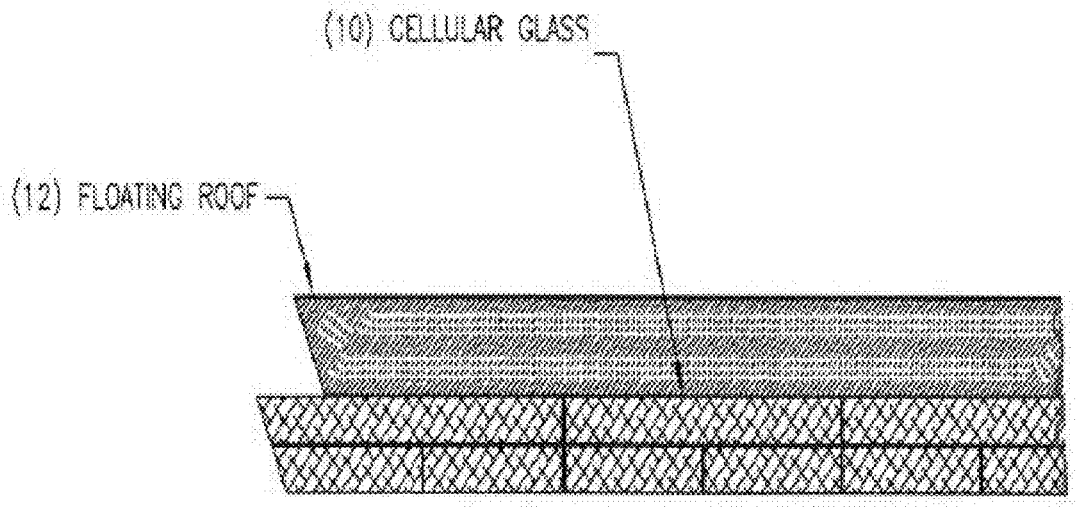
FIG. 8 illustrates a partial cross-section detail of a passive system of a cellular glass block layer beneath a roof.

With reference to FIGS. 6-8, an embodiment of the present invention known as passive development is illustrated. With passive deployment, a buoyant cellular glass material 10 is placed on the roof 12 of an oil storage vessel 14 prior to an ignition event, where it will stay until such time as an oil fire collapses the roof 12 of the vessel 14. The roof 12 of the vessel 14 will subsequently sink in the burning oil 16, and the cellular glass 10 will float on the surface of the oil 16, thus attenuating the oil fire, limiting thermal radiation from the oil fire, and reducing the risk of boil over phenomenon resulting from vaporization of a liquid phase in the fuel.

During testing of the passive deployment of cellular glass on crude oil, temperatures only reached 140° C. in the uppermost layer of the oil after 100 minutes. No hot zone development was observed with the blocks in situ. While there is some heat conduction, penetration of the heat was low and boilover did not occur.

Examples of how cellular glass may be utilized in a passive deployment are as follows:

- Cellular glass is deployed on the roof of oil storage vessel prior to ignition event in block, sheet, aggregate or nodule form.
- Cellular glass is deployed in blocks or sheets covering the surface of the roof area on an oil storage vessel.
- Cellular glass block or sheet may be deployed in a single layer or multiple layers up to a maximum weight the roof of the oil storage vessel is able to support.
- Cellular glass may be deployed as aggregate loosely strewn across the roof area of the oil storage vessel in depths up to a maximum weight the roof of the oil storage vessel is able to support.
- Cellular glass may be deployed as aggregate in bags aimed to contain the cellular glass until it is released by oil fire.

Cellular glass may be deployed under the roof, serving as the fire-resistant flotation component of the roof itself (FIG. 8).

- Glass spheres may be deployed loosely strewn across the roof area of the oil storage vessel in depths up to a maximum weight the roof of the oil storage vessel is able to support.
- Glass spheres may be deployed in bags aimed to contain the spheres until it is released by oil fire.

As opposed to passive deployment, active deployment refers to the release of cellular glass, hollow glass spheres or other buoyant glass in response to ignition and fire in order to attenuate oil fires, limit thermal radiation from oil fires, and reduce the risk of boil over phenomenon resulting from vaporization of a liquid phase in the fuel. The cellular glass aggregate or hollow glass spheres may be deployed, for example, via pneumatic or mechanical systems. In this methodology, the buoyant glass product may be mixed with a firefighting foam or spread onto the surface of the oil using another methodology, such as a pneumatic gravel truck or gravity fed via a storage bin.

Although the invention has been described in terms of particular embodiments in an application, one of ordinary skill in the art, in light of the teachings herein, can generate additional embodiments and modifications without departing from the spirit of, or exceeding the scope of, the claimed invention. Accordingly, it is understood that the drawings and the descriptions herein are proffered by way of example only to facilitate comprehension of the invention and should not be construed to limit the scope thereof.

What is claimed is:

1. A method of extinguishing an oil fire in an oil-containing vessel containing oil having a surface, the method comprising:

- placing cellular glass blocks on top of a floating roof of the oil-containing vessel prior to an ignition event causing the oil fire;
- retaining the cellular glass blocks on top of the floating roof of the oil-containing vessel until such time as the oil fire collapses the roof of the oil-containing vessel;
- coating the cellular glass blocks with high expansion foam;
- sinking the floating roof of the oil-containing vessel in the oil; and
- floating the coated cellular glass blocks on the surface of the oil contained in the oil-containing vessel in order to extinguish the oil fire.

* * * * *